US008180272B2

(12) United States Patent
Richards et al.

(10) Patent No.: US 8,180,272 B2
(45) Date of Patent: May 15, 2012

(54) MOVABLE TRAIL EDGE SENSOR FOR DUPLEX REGISTRATION

(75) Inventors: Paul N. Richards, Fairport, NY (US); Lloyd A. Williams, Mahopac, NY (US); Joannes N. M. deJong, Hopewell Junction, NY (US); Matthew Dondiego, West Milford, NJ (US)

(73) Assignee: Xerox Corporation, Norwalk, CT (US)

( * ) Notice: Subject to any disclaimer, the term of this patent is extended or adjusted under 35 U.S.C. 154(b) by 521 days.

(21) Appl. No.: 12/433,368

(22) Filed: Apr. 30, 2009

(65) Prior Publication Data

US 2010/0278573 A1 Nov. 4, 2010

(51) Int. Cl.
*G03G 15/00* (2006.01)

(52) U.S. Cl. ..... 399/388; 399/394; 399/395; 271/226; 271/227

(58) Field of Classification Search ..... 399/401, 399/394, 395, 364, 388; 271/291, 227, 226, 271/258.01
See application file for complete search history.

(56) References Cited

U.S. PATENT DOCUMENTS 5,094,442 A 3/1992 Kamprath et al.
5,697,608 A 12/1997 Castelli et al.
5,715,514 A 2/1998 Williams et al.
6,059,285 A 5/2000 Suga et al.
6,533,268 B2 3/2003 Williams et al.
6,575,458 B2 6/2003 Williams et al.
6,834,853 B2 12/2004 Trovinger et al.
6,866,260 B2 3/2005 Williams et al.
7,219,888 B2 5/2007 Trovinger et al.
7,500,668 B2 3/2009 DeJong et al.
2006/0208416 A1 * 9/2006 Dejong et al. ..... 271/228
2007/0025788 A1 2/2007 deJong et al.
2008/0309006 A1 * 12/2008 Iguchi et al. ..... 271/227

* cited by examiner

*Primary Examiner* — Matthew G Marini
(74) *Attorney, Agent, or Firm* — Fox Rothschild LLP

(57) ABSTRACT

A print device for registering a printable medium during a duplex printing process. The print device includes a controller, at least one leading edge sensor operably connected to the controller, the at least one leading edge sensor configured to detect a leading edge of a printable medium having a first and a second side when the first side is facing away from the at least one leading edge sensor, a coarse registration sensor operably connected to the controller, the coarse registration sensor configured to detect a leading edge of the printable medium when the second side of the printable medium is facing away from the at least one leading edge sensor, and at least one trail edge sensor operably connected to the controller, the at least one trail edge sensor configured to detect a trailing edge of the printable medium.

18 Claims, 5 Drawing Sheets

MOVABLE TRAIL EDGE SENSOR FOR DUPLEX REGISTRATION

BACKGROUND

The present invention relates to a trail edge sensor for a printing device and more specifically to a moveable trail edge sensor for duplex registration in a printing device.

In many printing applications, a printing device includes a registration system for determining any skew or misalignment of printable media prior to the print process. Eliminating skew is used to ensure that any images and/or text printed on a printable medium are correctly aligned. Eliminating skew is particularly useful in duplex printing system. A duplex printing system transports a printable medium through a registration system, prints on a first side of the printable medium, inverts the printable medium, transports the inverted medium back through the registration system and runs the medium through the print process a second time. This results in a printable medium with images and/or text printed on both sides. Eliminating skew during the printing of both the first and second sides results in images or text that are properly aligned on both sides of the printable medium. FIG. 1 illustrates a simplified duplex printing system 100.

As shown in FIG. 1, a printable medium is loaded at feeder 102. The printable medium travels down a transport surface to registration device 104. Here, the leading and trailing edges of the printable medium are determined, and any skew is removed via a registration system. Next, the printable medium passes imaging device 106. Imaging device 106 transfer any images and/or text onto the printable medium. After image transfer, the printable medium passes through fuser 108 where the transferred image and/or text is fused to the printable medium. The printable medium then passes to inverter 110 where the printable medium is inverted and passes down along duplex path 112.

The printable medium again is passed to registration device 104. On the second pass, a second side of the printable medium is facing away from the transport surface. Again, the printable medium is aligned to remove any skew, an image and/or text is transferred by imaging device 106, and the transferred image is fused by fuser 108. Having already been inverted and printed on both sides, the printable medium bypasses the inverter 110 and exits the printing system. It should be noted the location of the inverter 110 may be moved to other locations including along duplex path 112. Additionally, it should be noted that in some applications the printable medium may be inverted again after the second side is printed such that the first side is facing up as the printable medium exits the duplex printing system.

FIG. 2*a* illustrates an exemplary printable media transport system including an exemplary registration device 104. As the printable medium passes through the transport system, it is propelled by transport nips 202 and passes over various sensors. As the printable medium approaches registration device 104, it passes over a first side edge sensor 204*a*. As the printable medium advances, it passes over a second side edge sensor 204*b*. These side edge sensors are used to determine any skew in the printable medium. Registration device 104 adjusts the speed of nips 205*a* and 205*b* to adjust the skew of the printable medium. The printable medium also passes over a leading edge sensor 206. Sensor 206 measures the arrival time of the lead edge of the printable medium. As the printable medium continues through registration device 104, it passes a second leading edge sensor 208. Sensor 208 measures the arrival time of the lead edge of the printable media and determines and adjusts the velocity of the printable medium by adjusting the speed of transport nips 202. After the velocity is adjusted, the printable medium is passed to registration datum 212 where the registration process is completed and the image is transferred to the printable medium.

The printable medium follows a similar path to that described in FIG. 1, it is inverted and returned to the registration device 104. In this pass, the second side of the printable medium is facing the imaging device, and what was previously the leading edge is now the trailing edge. The trailing edge is measured in the second pass to maintain consistency between the two passes that the printable medium makes through the registration device because it was previously the leading edge of the printable medium before inversion. Again, any skew in the printable medium is adjusted, and the printable medium is passed towards the registration datum 212. In the second pass, however, trail edge sensor 210 is used to measure the trail edge of the printable medium. The velocity of the printable medium is determined and adjusted based upon previous measurements of the leading edge in the first pass, and the printable medium is passed to the image transfer device. It should be noted that a single trail edge measurement is taken in this pass as the printable medium approaches registration datum 212. Multiple trail edge sensors 210 may be included to accommodate different process direction sizes of printable media.

A registration system such as the one illustrated in FIG. 2*a* has inherent drawbacks though. For example, during the fusing process, heat is applied to the printable medium which may result in a slight deformation of the medium resulting in dimensional changes in the medium. For example, the length of the printable medium may change, which would result in an inaccurate velocity measurement of the medium. Another drawback is the printable medium is passed over additional transport nips after registration. Any variance in speed in the transport nips may result in skewing the printable medium prior to image transfer. To overcome these drawbacks, some printing systems eliminate the intermediate transport nips between registration and passing the medium to the registration datum.

FIG. 2*b* illustrates an exemplary printable media transport system where the intermediate transport nips have been removed between the registration device 204 and the registration datum 212. The process for printing the first side of the printable medium is similar to that as discussed above in the discussion of FIG. 2*a*. As the printable medium travels towards registration datum 212, sensors 204*a* and 204*b* measure any skew and nips 205*a* and 205*b* adjust the lateral position of the printable medium to eliminate the skew. Leading edge sensors 206 and 208 measure the leading edge of the printable medium as it passes to determine the velocity of the medium. The velocity of the printable medium is adjusted and passed to registration datum 212 for image transfer and fusing. The printable medium is then inverted as before.

After inversion, the printable medium is passed through registration device 204 again with the second side of the medium facing up. Similar to the system described in FIG. 2*a*, the trail edge is now measured by trail edge sensor 210 to determine and adjust velocity prior to printing. However, trail edge sensor 210 is positioned such that the measurement of the trail edge of the printable medium occurs while the registration device 204 is correcting any skew to the printable medium. If there is an adjustment made to correct skew, the measurement made by the trail edge sensor is inaccurate as the position of the trail edge of the printable medium may change based upon the skew correction.

Both of these registration devices include their drawbacks, primarily inaccurate measurements after the paper is inverted and prior to transferring the image to the second side of the printable medium. As discussed above, inaccurate measurements may lead to incorrect printing on the printable medium as the two printed sides may not properly align.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "printable medium" is a reference to one or more printable media and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In one general respect, the embodiments disclose a print device. The print device includes a controller, at least one leading edge sensor operably connected to the controller, the at least one leading edge sensor configured to detect a leading edge of a printable medium having a first and a second side when the first side is facing away from the at least one leading edge sensor, a coarse registration sensor operably connected to the controller, the coarse registration sensor configured to detect a leading edge of the printable medium when the second side of the printable medium is facing away from the at least one leading edge sensor, and at least one trail edge sensor operably connected to the controller, the at least one trail edge sensor configured to detect a trailing edge of the printable medium when the second side of the printable medium is facing away from the at least one leading edge sensor.

In another general respect, the embodiments disclose a method of registering a printable medium in a printing system. The method includes performing registration for a first side of a printable medium as the printable medium passes through a media registration device, transferring an image onto a first side of the printable medium at an image transfer device, inverting the printable medium such that a second side of the printable medium faces the image transfer device, performing coarse registration on the printable medium to define a leading edge of the second side, performing fine registration on the printable medium to define a trailing edge of the second side of the printable medium, and transferring an image onto the second side of the printable medium at an image transfer device.

In another general respect, the embodiments disclose a print system. The print system includes a printable media registration device, an imaging device operably connected to the printable media registration device and configured to transfer text and/or an image to a printable medium, and a printable medium inverter operably connected to the imaging device and configured to receive and invert a printable medium. The printable media registration device further includes a controller, at least one leading edge sensor operably connected to the controller, the at least one leading edge sensor configured to detect a leading edge of a printable medium having a first and a second side when the first side is facing away from the at least one leading edge sensor, a coarse registration sensor operably connected to the controller, the coarse registration sensor configured to detect a leading edge of the printable medium when the second side of the printable medium is facing away from the at least one leading edge sensor, and at least one trail edge sensor operably connected to the controller, the at least one trail edge sensor configured to detect a trailing edge of the printable medium when the second side of the printable medium is facing away from the at least one leading edge sensor.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below, a "printable medium" refers to a physical sheet of paper, plastic and/or other suitable substrate for printing images thereon.

A "printing system" is an electronic device that is capable of receiving commands, registering and aligning a printable medium, and printing text and/or images on a printable medium. Printing systems may include, but are not limited to, network printers, production printers, copiers and other devices using ink or toner. Printing systems that invert a printable medium to provide printing of text and/or images on both sides of the printable medium are referred to as a duplex printing systems.

A "nip" refers to a location in a print system at which a force is applied to a printable medium by drive rollers to propel the printable medium in a process direction.

A printable media transport system is a collection of transport belts and/or nips used to propel a printable medium through a print system in a process direction.

Figure 3:
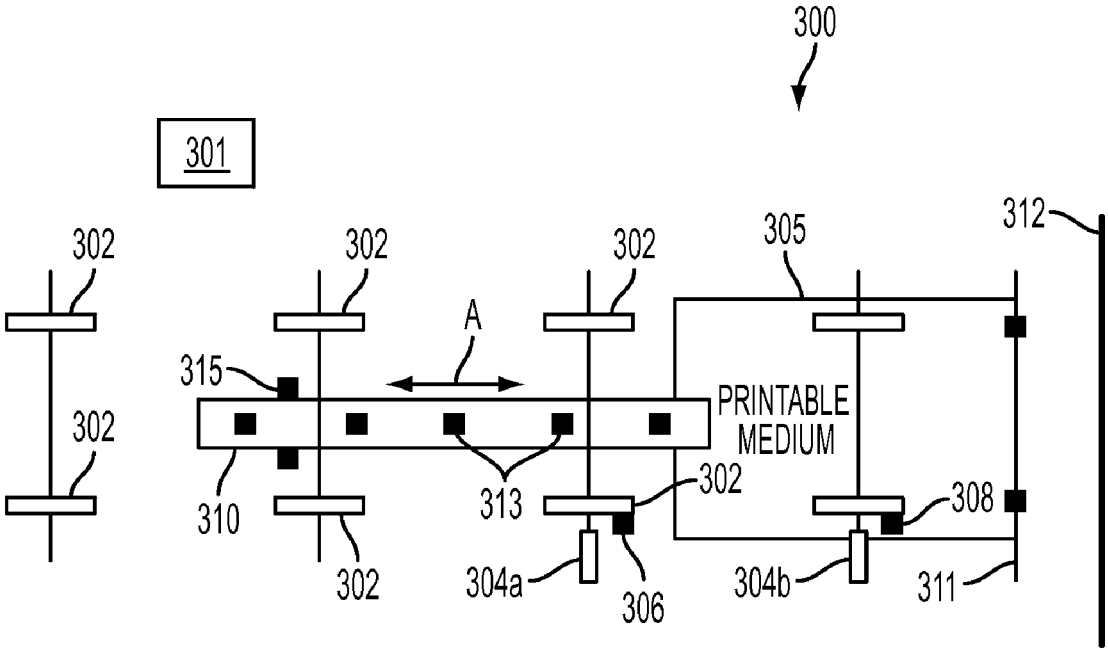
FIG. 3 illustrates an exemplary printable media transport system including an exemplary registration device having a moveable trail edge sensor according to an embodiment.

FIG. 3 illustrates an overhead view printable media registration device 300. Printable media registration device 300 may be included in a print system along with other various components, such as a printable media transport system, an imaging device, and, if the print system is a duplex print system, an inverter.

Operation of individual components of printable media registration device 300 may be controlled by controller 301. As a printable medium 305 passes through a printable media transport system, it may be propelled by transport nips 302. Transport nips 302 may be small plastic (e.g., polycarbonate or urethane), metal (e.g., stainless steel) or rubber cylinders rotating at either a constant speed or at a variable speed depending on the application. The speed at which transport nips 302 rotate may be controlled by controller 301. As the transport nips 302 rotate, friction between the transport nips and the printable medium 305 may cause the printable medium to be transported through the media registration device 300. As the printable medium 305 is transported through media registration device 300, it ultimately reaches registration datum 312 where the printable medium is passed to an imaging device. As the printable medium 305 approaches registration datum 312 it may pass over a first side edge sensor 304*a*. As the printable medium 305 advances, it may pass over a second side edge sensor 304*b*. Controller 301 may use information received from these side edge sensors to determine any lateral skew in the printable medium 305. Controller 301 may adjust the speed of transport nips 302 near sensors 304*a* and 304*b* to adjust the skew of the printable medium 305. The printable medium 305 may also pass over a leading edge sensor 306. Sensor 306 may detect the arrival of the lead edge of the printable medium 305 and transfer this information to controller 301 to determine a first arrival time. As the printable medium 305 continues through media registration device 300, it may pass a second leading edge sensor 308. Sensor 308 may detect the arrival of the lead edge of the printable medium 305 and communicate this information to controller 301 to determine a second arrival time. Based on the first and second arrival times and the distance between sensors 306 and 308, controller 301 may determine and adjust the velocity of the printable medium 305 by adjusting the speed of transport nips 302. After the velocity is adjusted, the printable medium 305 is passed to registration datum 312 where the registration process is completed. An image and/or text is transferred to the printable medium at an imaging device.

Figure 1:
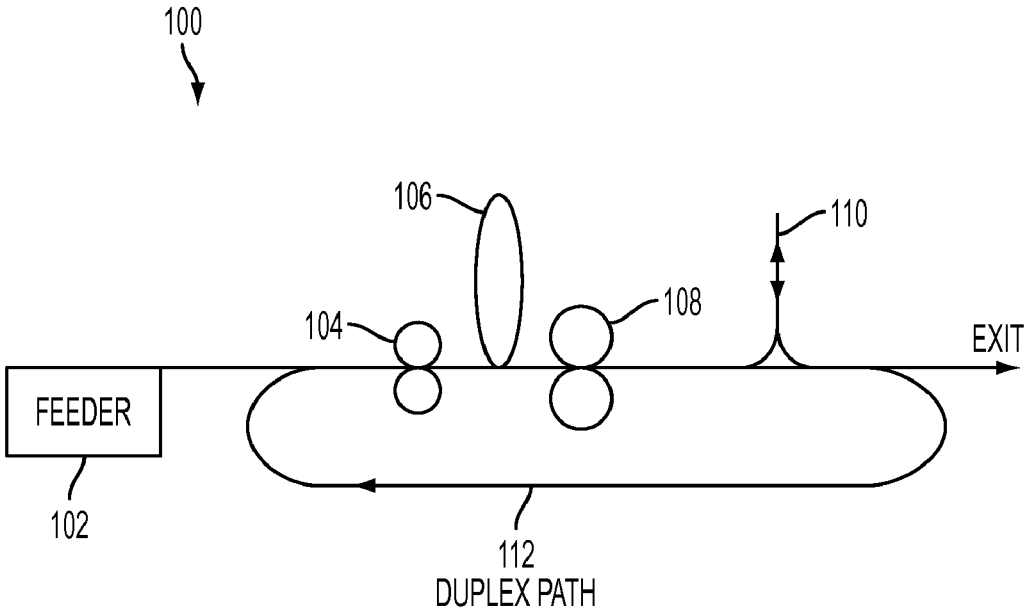
FIG. 1 PRIOR ART
FIG. 1 illustrates various embodiments of a conventional duplex printing system.
Figure 2A:
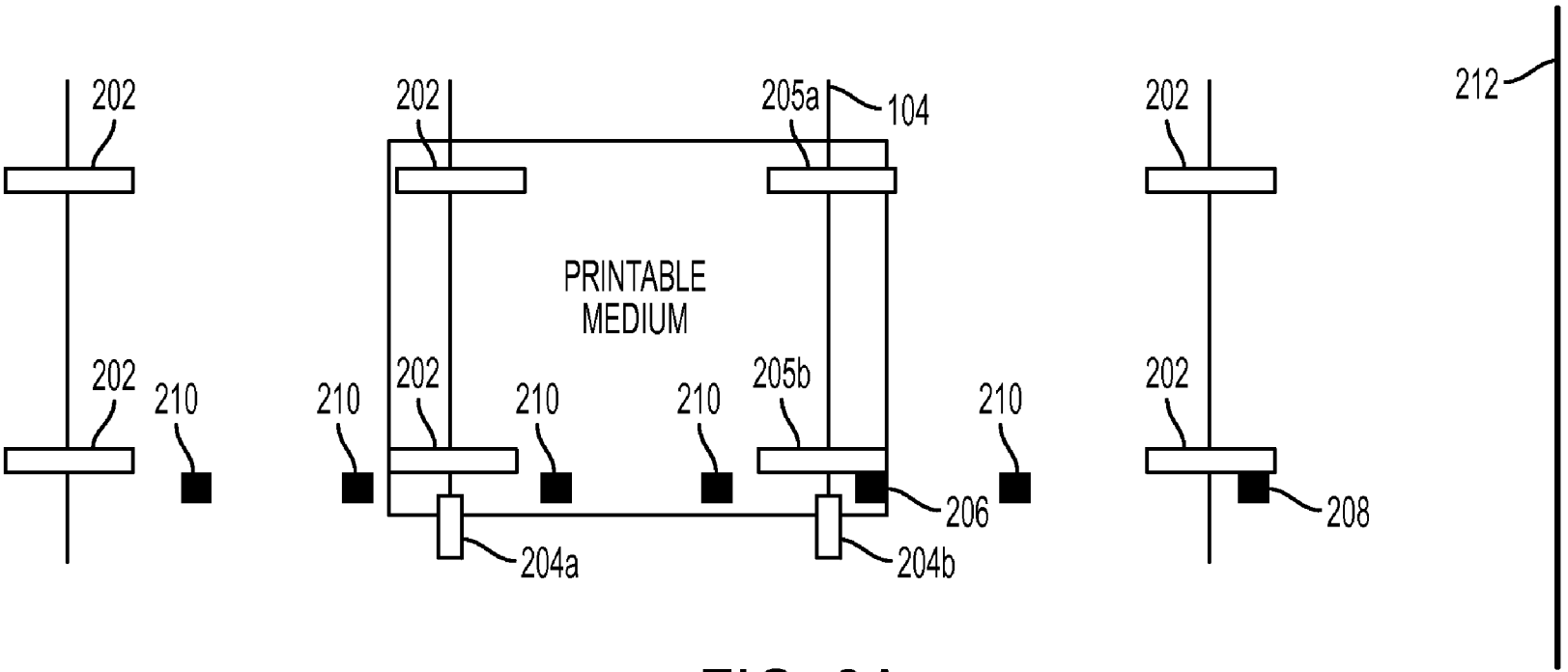
FIG. 2A PRIOR ART
FIGS. 2*a*-2*b* illustrate various embodiments of a conventional printable media transport system including various exemplary registration devices.
Figure 2B:
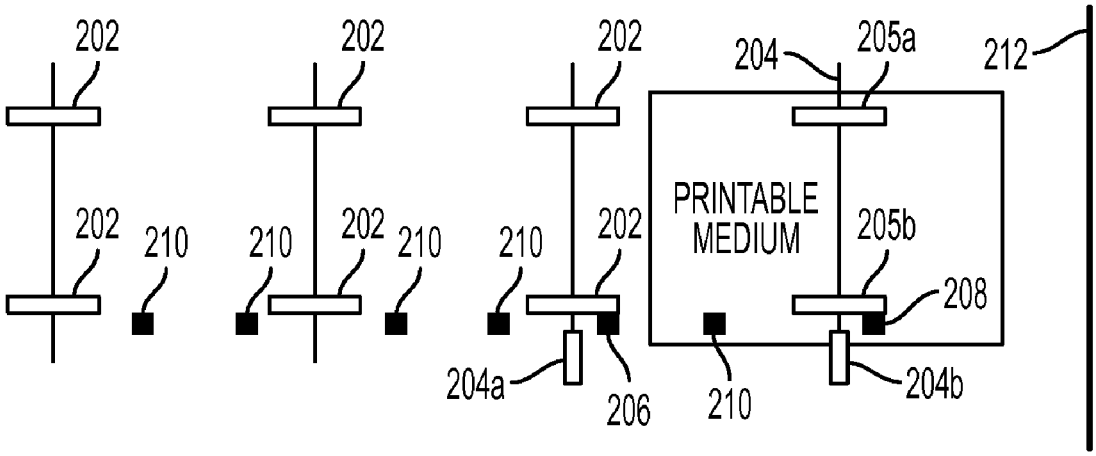
FIG. 2B PRIOR ART

After the first side of the printable medium 305 passes through the imaging device, the printable medium may follow a similar path to that of print system 100 described in FIG. 1. The printable medium 305 may be inverted and returned to the media registration device 300. In the second pass, the second side of the printable medium 305 faces the imaging device, and what was previously the leading edge in the first pass is now the trailing edge in the second pass. The trailing edge may be measured in the second pass to maintain consistency between the two passes the printable medium 305 makes through the registration device because it was the leading edge of the printable medium before inversion. Both the trailing edge and the leading edge of the second side of the printable medium 305 may be measured as the printable medium passes through media registration device 300 to accurately determine the size of the printable As the printable medium 305 passes through media registration device 300 for a second pass, transport nips 302 may transport the printable medium past sensors 304*a* and 304*b*. Lateral skew may be determined by controller 301 based on measurements from sensors 304*a* and 304*b* and corrected by adjusting the speed of the transport nips. The printable medium 305 may continue through the registration system 300 until it reaches the coarse registration sensor 311. Coarse registration sensor 311 detects the arrival of the leading edge of side two of the printable medium 305 and transfers this information to controller 301. However, unlike the registration process for side one, on the second pass both the leading edge and the trailing edge of the printable medium 305 are detected. While coarse registration sensor 311 detects the leading edge, controller 301 may cause trail sensor carriage 310 to be positioned substantially behind the printable medium 305. One of the mounted sensors 313 on the trail sensor carriage 310 may detect the trailing edge of the printable medium. By detecting both the leading and trailing edges of the printable medium 305, a fine or "exact" registration of the second side of the printable medium may be performed, unlike the coarse registration which includes merely detecting either the leading or trailing edges of the second side.

Trail sensors 313 may be positioned on trail sensor carriage 310 in various patterns. Each trail sensor 313 may be equidistant from adjacent trail sensor(s) (e.g., 2 inches). Alternatively, trail sensors 313 may be positioned along trail sensor carriage 310 at differing distances from adjacent trail sensors to accommodate for standard sized printable media (e.g., letter sized, legal sized, A4 sized printable media).

Trail sensor carriage 310 may be configured to travel in a direction parallel to the process direction of the printable medium 305 through the media registration system 300, as indicated by arrow A. This movement allows the trail sensor carriage 310 to make fine or minute adjustments to accurately measure the trail edge of the printable medium 305 as it passes over the trail sensor 313. An electromechanical motor such as a stepper motor may be used to move the trail sensor carriage 310 in increments determined by controller 301. A stepper motor is an motor that causes a full rotor rotation to occur as a series of steps by, for example, specific gearing or electromagnet positioning in the motor casing. By moving the rotor an identified number of steps, control of any devices attached to the stepper motor may be accurately controlled.

Additionally, a home sensor 315 may be included. Home sensor 315 may be rigidly mounted and used to detect and transmit the position of trail sensor carriage 310 to controller 301 so that the controller can accurately determine the location of the trail sensor carriage when determining the fine registration of the printable medium 305.

It should be noted that the use of a stepper motor for driving the trail sensor carriage is shown by way of example only. Any suitable motor or driving mechanism may be incorporated into the media registration device 300 discussed above. Similarly, controller 301 may be incorporated as a dedicated processor having a memory for storing and processing information and instructions used solely for the purposes of printable media registration. Alternatively, the controller 301 may be a shared resource, such as a centralized process and memory for storing and processing information and instructions for an entire printing system.

Figure 4:
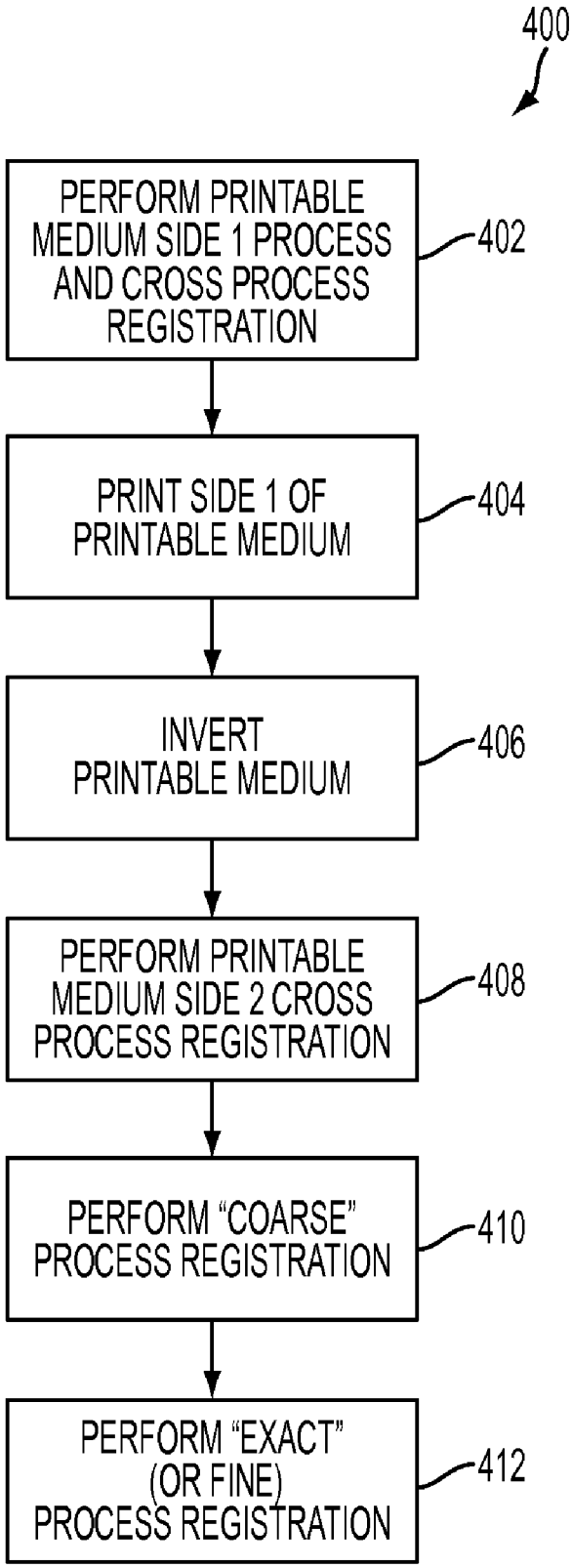
FIG. 4 illustrates a flowchart of an exemplary process for performing a duplex registration using the exemplary registration device of FIG. 3.

FIG. 4 illustrates an exemplary process 400 for printing both sides of a printable medium using a duplex printing system incorporating media registration device 300. A printable medium is registered 402 in both the process and cross process directions for printing on a first side. As discussed above, during registration 402, any lateral skew may be removed from the printable medium, and the speed of the printable medium may be adjusted. After the printable medium is registered 402 for the first side, the first side of the printable medium may be printed 404 at an imaging device (e.g., imaging device 106 of FIG. 1). The printable medium may be inverted 406 and returned to the media registration system to register the second side for printing.

The printable medium may be registered 408 in the cross process direction to remove lateral skew. A "coarse" registration may then be performed 410 in the process direction on the printable medium. The coarse registration may be performed 410 when the leading edge of the second side (which was the trailing edge of the first side) is detected and identified. Because the dimensions of the printable medium may change as a result of printing the first side, the registration may be considered coarse when only the leading edge of the second side of the printable medium is detected. The trailing edge of the second side of the printable medium may also be detected, and the fine or "exact" registration may be performed 412 in the process direction. Fine registration results in an accurate determination of the dimensions of the printable medium, and permits the registration device to make any adjustments prior to printing the second side of the printable medium. It should be noted that in particular applications the registration 408 in the cross process direction, the coarse registration 410 and the exact registration 412 in the process direction may also be performed for side 1 of the printable medium, as opposed to the simplified registration 402 process described above.

It should be noted that the above disclosed printable media registration systems may be incorporated into numerous printing devices. For example, a high speed duplex printing system capable of printing large scale printable media (e.g., 30 inches in width or greater) may utilize the media registration systems described herein. Similarly, a smaller scale duplex printing device used in an office environment handling mainly standard sized printable media (e.g., 8.5 inches in width) may utilize the media registration systems described herein as well.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A print device comprising;

a controller;

at least one leading edge sensor operably connected to the controller, the at least one leading edge sensor configured to detect a leading edge of a printable medium having a first and a second side when the first side is facing away from the at least one leading edge sensor;

a coarse registration sensor operably connected to the controller, the coarse registration sensor configured to detect a leading edge of the printable medium when the second side of the printable medium is facing away from the at least one leading edge sensor; and at least one trail edge sensor operably connected to the controller, the at least one trail edge sensor configured to detect a trailing edge of the printable medium when the second side of the printable medium is facing away from the at least one leading edge sensor.

2. The device of claim 1, wherein the controller is configured to receive information indicating the leading edge of the second side of the printable medium, receive information indicating the trailing edge of the second side of the printable medium, and determine a fine registration for the printable medium based upon the received information.

3. The device of claim 1, wherein the at least one trail edge sensor comprises a trail edge sensor array including a plurality of trail edge sensors.

4. The device of claim 3, wherein the trail edge sensor array is mounted on a movable sensor carriage.

5. The device of claim 4, wherein the movable sensor carriage is driven by an electromechanical motor.

6. The device of claim 4, further comprising a home sensor for determining the position of the movable sensor carriage.

7. The device of claim 3, wherein the plurality of trail edge sensors in the trail edge sensor array are positioned to measure different sized printable media.

8. A method of registering a printable medium in a printing system; the method comprising:

performing registration for a first side of a printable medium as the printable medium passes through a media registration device;

transferring an image onto a first side of the printable medium at an image transfer device;

inverting the printable medium such that a second side of the printable medium faces the image transfer device;

performing coarse registration on the printable medium to define a leading edge of the second side;

performing fine registration on the printable medium to define a trailing edge of the second side of the printable medium; and transferring an image onto the second side of the printable medium at an image transfer device.

9. The method of claim 8, wherein the trailing edge of the second side of the printable medium is defined by a trail edge sensor array.

10. The method of claim 9, wherein the trail edge sensor array is mounted on a movable sensor carriage.

11. The method of claim 10, wherein the media registration device further comprises a home sensor for determining a position of the movable sensor carriage.

12. A print system comprising:

a printable media registration device comprising:

a controller, at least one leading edge sensor operably connected to the controller, the at least one leading edge sensor configured to detect a leading edge of a printable medium having a first and a second side when the first side is facing away from the at least one leading edge sensor, a coarse registration sensor operably connected to the controller, the coarse registration sensor configured to detect a leading edge of the printable medium when the second side of the printable medium is facing away from the at least one leading edge sensor, and at least one trail edge sensor operably connected to the controller, the at least one trail edge sensor configured to detect a trailing edge of the printable medium when the second side of the printable medium is facing away from the at least one leading edge sensor, an imaging device operably connected to the printable media registration device and configured to transfer text and/or an image to a printable medium; and a printable medium inverter operably connected to the imaging device and configured to receive and invert a printable medium.

13. The system of claim 12, wherein the controller is configured to receive information indicating the leading edge of the second side of the printable medium, receive information indicating the trailing edge of the second side of the printable medium, and determine a fine registration for the printable medium based upon the received information.

14. The system of claim 12, wherein the at least one trail edge sensor comprises a trail edge sensor array including a plurality of trail edge sensors.

15. The system of claim 14, wherein the trail edge sensor array is mounted on a movable sensor carriage.

16. The system of claim 15, wherein the movable sensor carriage is driven by an electromechanical motor.

17. The system of claim 15, further comprising a home sensor for determining the position of the movable sensor carriage.

18. The system of claim 14, wherein the plurality of trail edge sensors in the trail edge sensor array are positioned to measure different sized printable media.

* * * * *